US009011091B2

(12) United States Patent
Weber et al.

(10) Patent No.: US 9,011,091 B2
(45) Date of Patent: Apr. 21, 2015

(54) PUMP AND FLOW-GUIDING DEVICE

(75) Inventors: Wolfgang Weber, Eschwege (DE); Tobias Albert, Kraichtal (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 597 days.

(21) Appl. No.: 13/410,639

(22) Filed: Mar. 2, 2012

(65) Prior Publication Data

US 2012/0224957 A1 Sep. 6, 2012

(30) Foreign Application Priority Data

Mar. 4, 2011 (DE) ..... 10 2011 005 139

(51) Int. Cl.
*F04D 29/46* (2006.01)
*F04D 29/44* (2006.01)

(52) U.S. Cl.
CPC ..... *F04D 29/468* (2013.01); *F05D 2240/12* (2013.01); *F04D 29/445* (2013.01); *F04D 29/448* (2013.01)

(58) Field of Classification Search
CPC .. F04D 29/466; F04D 29/468; F05D 2240/12
USPC ..... 415/211.2
See application file for complete search history.

(56) References Cited

U.S. PATENT DOCUMENTS 1,988,163 A * 1/1935 Church ..... 417/323
2,648,195 A * 8/1953 Light et al. ..... 60/794
4,642,026 A * 2/1987 Ruff ..... 415/150
8,197,193 B2 * 6/2012 Messmer ..... 415/126
2009/0301412 A1 12/2009 Genster
2010/0126534 A1 5/2010 Büsing et al.

FOREIGN PATENT DOCUMENTS

| | | |
|---|---|---|
| EP | 2028314 | 2/2009 |
| EP | 2028374 | 2/2009 |
| EP | 2131042 A2 | 12/2009 |
| FR | 921711 A | 5/1947 |
| FR | 2153796 A5 | 5/1973 |
| GB | 180823 | 6/1922 |

(Continued)

OTHER PUBLICATIONS

European Search Report dated Dec. 2, 2013 in European Application No. P51128 EP.

(Continued)

*Primary Examiner* — Ninh H Nguyen
(74) *Attorney, Agent, or Firm* — Lee & Hayes, PLLC

(57) ABSTRACT

A flow-guiding device for an impeller radial pump is arranged radially outside the impeller and extends in a ring-shaped manner with a circumferential carrier ring on which several guide blades are arranged. These latter are formed so as to be resilient in such a manner that when there is a small fluid flow a blade angle points more in the radial direction at an angle of approximately 70° with respect to the longitudinal center axis of the pump. When there is strong fluid flow, the angle becomes smaller and the guide blades bend in a resilient manner at least in regions such that they stand at a smaller angle of between 30° and 40° with respect to the longitudinal center axis of the pump. The fluid is conveyed better in the pump chamber in this way.

27 Claims, 5 Drawing Sheets

(56) References Cited

FOREIGN PATENT DOCUMENTS

| | | |
|---|---|---|
| GB | 206825 | 1/1924 |
| SU | 1076640 A1 | 2/1984 |

OTHER PUBLICATIONS

German Office Action dated Feb. 22, 2012 in DE 10 2011 005 139.2 (Mar. 4, 2011).

* cited by examiner

PUMP AND FLOW-GUIDING DEVICE

SCOPE AND PRIOR ART

The invention relates to a flow-guiding device for a pump, to be precise an impeller radial pump, as well as to a pump having such a flow-guiding device therein.

EP 2150165 A2 discloses pumping fluid using an impeller radial pump and heating it at the same time. Preferred applications are dishwashers and washing machines. In this case, a heating device is provided on a radially outer chamber wall such that fluid flowing past said wall is heated. Depending on the operating state, a fluid flow is weaker or stronger. The temperature to which the fluid flow is to be heated is also to be variable. It is important, therefore, that the ratio between fluid flow and target temperature of the incoming flow past the heated chamber wall is always as good as possible.

OBJECT AND SOLUTION

The object underlying the invention is to create an aforementioned flow-guiding device as well as a pump which is provided with such a device, by way of which problems of the prior art can be avoided and an optimally working flow-guiding device can be created in a pump in particular with low expenditure on production and assembly.

This object is achieved by a flow-guiding device with the features of claim 1 as well as by a pump with the features of claim 24. Advantageous as well as preferred developments of the invention are the subject of the further claims and are explained in more detail below. In this case, some of the features named below are named either only for the flow-guiding device or only for the pump. Irrespective of this, however, they should be able to be applicable both to the flow-guiding device and to the pump. The wording of the claims is incorporated in the content of the description by express reference.

It is provided that the flow-guiding device is designed to be arranged in a pump chamber of an impeller radial pump. An impeller rotates therein for conveying the fluid or for discharging the fluid in the radial direction out of the impeller. In this case, the fluid flow circulates in the pump chamber and toward a pump discharge port. The flow-guiding device is to be arranged radially outside the impeller and is to extend in a ring-shaped manner about said impeller. It has a circumferential carrier ring. Either one continuous flow lip or several individual guide blades can be arranged on the carrier ring. They have a certain blade angle with respect to the longitudinal center axis of the pump and are to guide the fluid flow in the pump chamber, not only in a general manner but in dependence on the strength of the fluid flow in a stronger or less strong manner onto the aforementioned chamber wall. In this case, the flow lip or guide blades are formed so as to be resilient or movable in such a manner that their blade angle alters in dependence on the strength of the fluid flow. When there is a small or a weak fluid flow, a blade angle points more or in a more pronounced manner in the radial direction and is larger or relatively large; the blade angle is preferably between 75° and 90°. Thus, where possible, the entire fluid flow is to be directed strongly or directly against the chamber wall.

When there is a larger or stronger fluid flow, the blade angle becomes smaller, the flow lip or guide vanes curving or moving in a resilient manner at least in regions toward the longitudinal center axis of the pump. When there is a large or a maximum fluid flow, the blade angle can be between 20° and 60°, preferably between approximately 30° and 40°, with respect to the longitudinal center axis of the pump. This means that the fluid flow is then no longer directed so strongly against the chamber wall as it flows strongly anyway and consequently also flows in a stronger manner against the chamber wall. In addition, the conveying performance of the pump should then not be unnecessarily restricted by a flow lip or guide blades standing too much into the fluid flow.

In an advantageous manner, the flow lip or the guide blades protrude from the carrier ring toward the pump discharge port in an angled manner. Consequently they effect a guiding of the fluid flow both in the direction of the chamber wall and toward the pump discharge port.

In a particularly advantageous manner, it is provided that the flow lip or the guide blades are certainly arranged radially outside the impeller in the pump. However, they should not be arranged directly in the fluid flow discharged out of the impeller, but where possible on the edge thereof, in particular opposite a pump base. In this way, on the one hand their flow resistance is slight and on the other hand they are better able to direct the entire fluid flow, in particular between themselves and the pump base.

In an advantageous development of the invention, the carrier ring is arranged somewhat above the impeller when viewed along the longitudinal center axis of the pump.

According to a first basic development of the invention, the carrier ring is arranged on an inner wall of the pump chamber and in an advantageous manner is fastened thereon, for example clamped or latched. The flow lip or the guide blades protrude from the carrier ring outwardly in the radial direction in the afore-described manner. The advantage in this case is that the carrier ring with the flow lip and guide blades thereon is then a single part, which is not too complicated and is able to be mounted easily in the pump.

According to a second basic development of the invention, the carrier ring is connected to a circumferential holding ring by means of radially extending holding webs. The holding ring can also be a section or part of another component, for example of a circumferential ring seal. The holding webs and the holding ring or ring seal can be fabricated together using a multi-component injection molding technique. In an advantageous manner, the holding webs extend in this case substantially radially outward and the holding ring has a larger diameter than the carrier ring. This means that it is possible for the flow lip or guide blades also to protrude from a radially inside carrier ring, but this latter, in its turn, is fastened radially outside, in particular close to an outer edge of the pump chamber, by means of the holding webs. An easier fastening can possibly be effected in this region or, in the case of one structural unit with the named circumferential ring seal, a single component is able to fulfill several functions.

In a first basic form of the invention, a circumferentially closed flow lip, which extends approximately in a uniform manner, is provided on the carrier ring. In particular it has a constant width and cross section in the circumferential direction. In a preferred manner it is formed so as to be resilient or movable about the carrier ring and to this end no pivotably movable parts are necessary. This is possible above all by production from a resilient plastics material or elastomer. By altering the thickness in the radial development it is possible to obtain the respective curvature or mobility for changing the aforementioned blade angle. It is therefore seen as advantageous here when the flow lip becomes thinner outwardly in the radial development proceeding from a somewhat larger thickness on the inner side. The thickness can be halved for example. In the case of a continuous ring, it can certainly be that during the movement or pivoting toward smaller blade angles a certain deforming takes place through pressure or compression in the circumferential direction. However, a correspondingly resilient material can balance this out. Notches or slots on the radial outer side, which can promote this, are also possible here.

In a second basic form of the invention, several guide blades are provided. These are narrow and oblong in the circumferential direction and have an approximately rectangular surface. Consequently, overall, they also form a type of circumferential ring in a similar manner to the afore-described flow lip.

In this case, according to a first variant, the guide blades have a cross section, which is constant in the circumferential direction and certainly tapers from inside to outside in the radial direction. A factor of the tapering can be between 1.5 and 3. It is either possible, in a similar manner to the case of the afore-described flow lip, to achieve through said tapering that when the fluid flow is stronger the individual guide blades, which are mounted radially inside, pivot more strongly radially outward and consequently produce the smaller blade angle in the case of a stronger fluid flow. In this case, the mobility is a purely inherent characteristic of the guide blades.

As an alternative or also in addition to this it can be provided that the guide blades are movable about an axis. In an advantageous manner, said axis is ring-like or extends along the carrier ring. To this end, either individual guide blades per se are provided with a rotational axis bearing arrangement on the carrier ring, for example by short bearing journals protruding from the guide blade on the one hand or from the holding web supporting them on the other hand and engaging in short receiving bores on the holding web on the one hand or the guide blade on the other hand. By means of corresponding resilient stops, it is possible to create a resistance, which acts in opposition to the pivoting movement.

As an alternative to this and in an advantageous manner, the carrier ring is resilient at least in regions such that no more parts or pivotably movable parts are required. In particular, the carrier ring for the guide blades is formed from a resilient or rubber-elastic material in the region between the guide blade and the holding web, that is to say to the left and right of each guide blade. Consequently, as the fluid flow becomes stronger, the guide blades can distort the carrier ring in the resilient region and thus modify the blade angle. The holding web, in its turn, can consist of a sturdy material. In addition to this, through guide blades made of resilient material or rather through their tapering toward the radial outer region, it is also possible to achieve a more pronounced pivoting or movement toward the smaller blade angles.

In a third basic form of the invention, individual guide blades are provided once again in the circumferential direction. These are fastened on the carrier ring only at one radially inner corner region, and in an advantageous manner they are not fastened directly on the carrier ring but on ends of holding webs which protrude from the carrier ring, in a particularly advantageous manner which protrude radially inward from an outside carrier ring. In a particularly advantageous manner, in this case, each guide blade is fastened on precisely one holding web by way of a corner region, which can be effected in a preferred manner by means of molding or spraying, in particular using the aforementioned multi-component injection molding technique.

A guide blade fastened or mounted in this manner only at one corner region is able to twist or distort in the circumferential direction along its longitudinal axis. This is less in the vicinity of the connection to the holding web, the twist becoming greater as the distance from the corner region increases. The twist can amount to an angle of approximately between 5° and 30° or even 45°, depending on the strength of the fluid flow. It can be reinforced by a reduction in the thickness in the direction away from the holding web. It can possibly even be provided that the curving or tilting of the guide blades in the longitudinal development of the guide blade is defined in the circumferential direction by a stop on the pump housing, in particular on an inner wall.

In addition, here too as described beforehand, in particular also as a result of a thickness tapering in the radial direction, the guide blade is able to curve more in a more pronounced manner when the fluid flow is stronger. A change in the blade angle is also achieved by this effect in the vicinity of the holding web. A factor of the thickness tapering can amount to between 1.5 and 3 here too.

As a result of this distorting of the guide blades, not only does the blade angle in general become smaller when the fluid flow is stronger, but as a result of the curving or twisting of the guide blades in the longitudinal development, even precisely when the fluid flow is large it is possible to achieve even better guiding of the fluid flow as it is still also circulating.

In an advantageous manner, several guide blades are arranged in a ring-shaped manner, in particular five to twelve guide blades. As a result of the larger number, a somewhat finer division in the circumferential direction can be provided for easier mobility or distortability.

In another further development of the invention it can be provided in general that the cross section of the aforementioned holding webs has a flow-promoting profile. In this way they can have a wide, rounded front side, which is turned against the fluid flow and tapers toward the rear side. This means that the fluid flow is braked less strongly.

An aforementioned holding ring, in the case of a pump according to the invention, can be provided, for example, in a region of the transition of the outer chamber wall to a pump base. A fastening there also possibly disturbs the fluid flow less. A circumferential ring seal together with the holding ring can be provided here anyway between chamber wall and pump housing or pump base and can consist of resilient material. By means of the aforementioned multi-component injection molding technique, it can be connected together to an advantageously radially inside holding ring made of sturdy material, the sturdy holding webs once again protruding from said holding ring. In this way, when the pump is being assembled, only one single part needs to be installed and the functions of sealing on the one hand and guiding the fluid flow on the other hand may be taken over by said one part.

These and further features also proceed from the description and the drawings as well as from the claims, the individual features being realized in each case on their own or as a plurality in the form of subcombinations in the case of an embodiment of the invention and in other areas and being able to represent advantageous designs which are patentable in their own right and for which protection is sought in this case. The division of the application into individual sections as well as intermediate headings does not restrict the universality of the statements made therein.

BRIEF DESCRIPTION OF THE DRAWINGS

Exemplary embodiments of the invention are shown in a schematic manner in the drawings and are explained in more detail below. In the drawings.

DETAILED DESCRIPTION OF THE EXEMPLARY EMBODIMENTS

Figure 1:
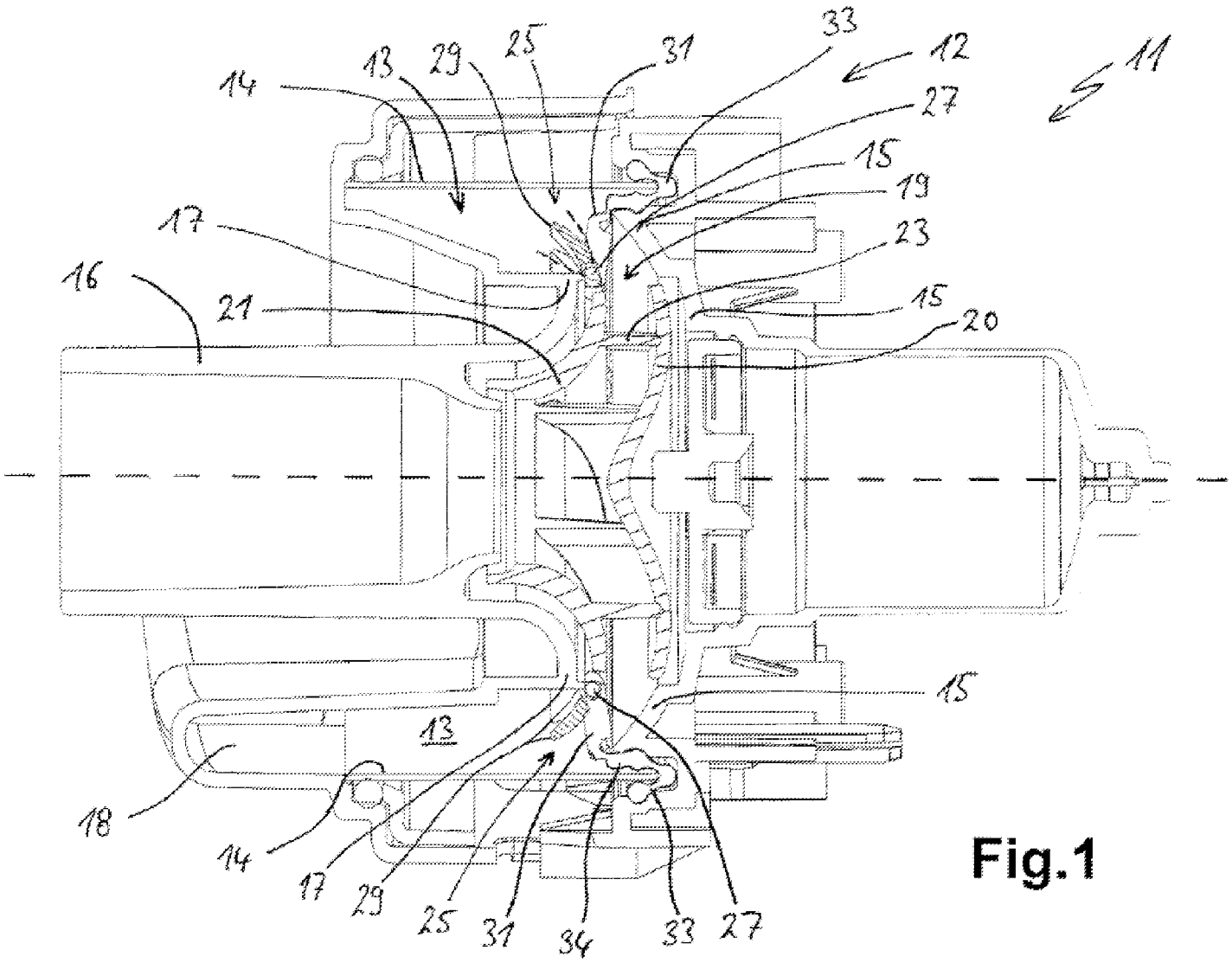
FIG. 1 shows a side section through a pump according to the invention with a first basic development of a flow-guiding device according to the invention.

FIG. 1 shows a side longitudinal section of a pump 11 according to the invention with a pump housing 12 in which there is a pump chamber 13 with an outer chamber wall 14. Such a design, which is usual per se, of a so-called radial pump is known, for example, from EP 2150165 A2.

A pump base 15 and a central axial tubular intake port 16 are additionally provided on the pump housing 12, said central axial tubular intake port merging into a pump cover 17, which, in its turn, merges into an inner wall, which then leads to a side discharge port 18.

The intake port 16 leads to an impeller 19, which is mounted in the usual manner above the pump base 15. It is formed as a closed impeller 19 with a bottom impeller disk 20, a top impeller disk 21 and primary guide blades 23 in between. For conveying fluid in the pump 11, the impeller 19 rotates and conveys fluid into the pump chamber 13 in a radial manner and with speed components in the circumferential direction. The chamber wall 14 is formed in a manner not shown as a heating element or is heated such that the fluid flowing along on the inner side of said chamber wall on its way to the discharge port 18 flows along thereon with several rotational movements and is heated. Reference is also made to the aforementioned EP 2150165 A2 to this end.

In order now to achieve conveying of fluid independently of the volumetric capacity of the pump 11 or of the fluid flow generated by the impeller 19, but also to achieve sufficient heating of said conveyed fluid with a small amount and at the same time to ensure that the heating element on the chamber wall 14 does not have to be regulated where possible and also does not burn out as a result of too little heat removal, the fluid flow here is to be directed where possible against the chamber wall 14. To this end, a flow-guiding device 25 is provided which extends in the manner of a ring about the region in the transition between the pump cover 17 and the top impeller disk 21 on the outer edge thereof.

The flow-guiding device 25 has several guide blades 29 on a circumferential carrier ring 27, said guide blades being shown dependent on the angular position by means of a broken line in order to show better their development. In this position they form quasi a continuation of the development of the top impeller disk 21, which, in this way, can be general and advantageous. The guide blades 29 are shown in a position when the fluid flow is of medium strength. In this case, the position at an angle of, for instance, 50° with respect to the longitudinal center axis of the pump 11, which is shown by a broken line, forms a good compromise between the inflow against the chamber wall 14 on the one hand and low flow resistance on the other hand. Finally, the volumetric capacity of the pump 11 is to be impaired as little as possible. A position for a weak fluid flow at an angle of, for instance, 70° with respect to the longitudinal center axis of the pump 11 is shown by a broken line, initially angled in a more pronounced manner to the right. Toward the left, that is to say pivoted even further, a position for a very strong or maximum fluid flow is shown, the angle with respect to the longitudinal center axis of the pump 11 being, for instance, 35°. These angles can obviously vary and are anyway fluid as they depend precisely on the generated fluid flow.

In principle, one side of the carrier ring 27 can certainly be arranged directly on the pump cover 17, either directly molded, bonded or fastened by means of latching or the like.

An alternative shown here, where the carrier ring 27 is arranged on radially extending holding webs, the design of which can be better seen from the following figures, is somewhat more expensive from the point of view of production expenditure, however from the point of view of assembly expenditure is simpler. These holding webs 31, which extend radially outward, are sprayed onto a circumferential V-seal fabricated from plastics material or elastomer. In this case, the holding webs 31 are sturdy or consist of sturdy plastics material so that they are able to hold the carrier ring 27 as much as possible always in the identical position. In this case, it is perfectly possible for the carrier ring 27, as can be seen, to abut against the pump cover 17, possibly even with certain prestressing, for secure support.

Figure 2:
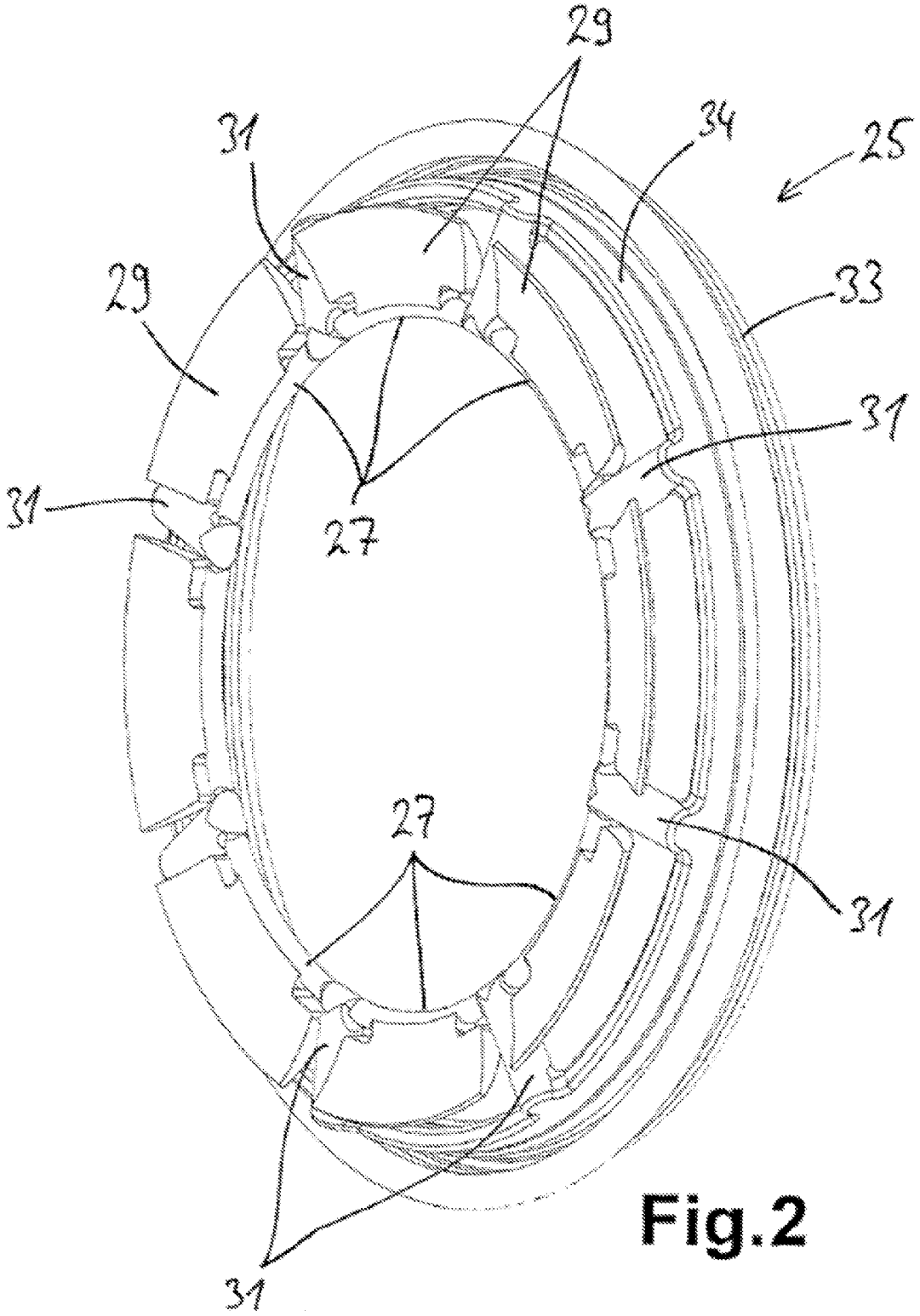
FIG. 2 shows an enlarged oblique representation of the flow-guiding device from FIG. 1 with a weak flow.

In the enlarged component drawing of the flow-guiding device 25 in FIG. 2 in the position for weak flow, it can once again be seen in detail that a radial inner ring section 34 is provided on the V-seal 33 as the aforementioned holding ring. It consists of the sturdy plastics material, but can be fabricated like the rest of the flow-guiding device 25 using a multi-component injection molding technique. It is located radially outward as a continuation of the pump base 15.

Eight evenly distributed holding webs 31 proceed from the ring portion 34 and point slightly inward in an angled manner. They also consist of the same sturdy plastics material. At their inner ends, the holding webs 31 have the circumferential carrier ring 27 or support said carrier ring and to this end are produced integrally with said carrier ring. The individual guide blades 29 are integrally molded so as to protrude in a radially outward and slightly angled manner on the sections of the carrier ring 27 between the holding webs 31. The guide blades 29 have an approximately rectangular form and in this case are slightly curved corresponding to the diameter in order to form a circular ring overall. Said circular ring produced from all the guide blades 29 is only interrupted by the cutouts for the holding webs 31.

Figure 3:
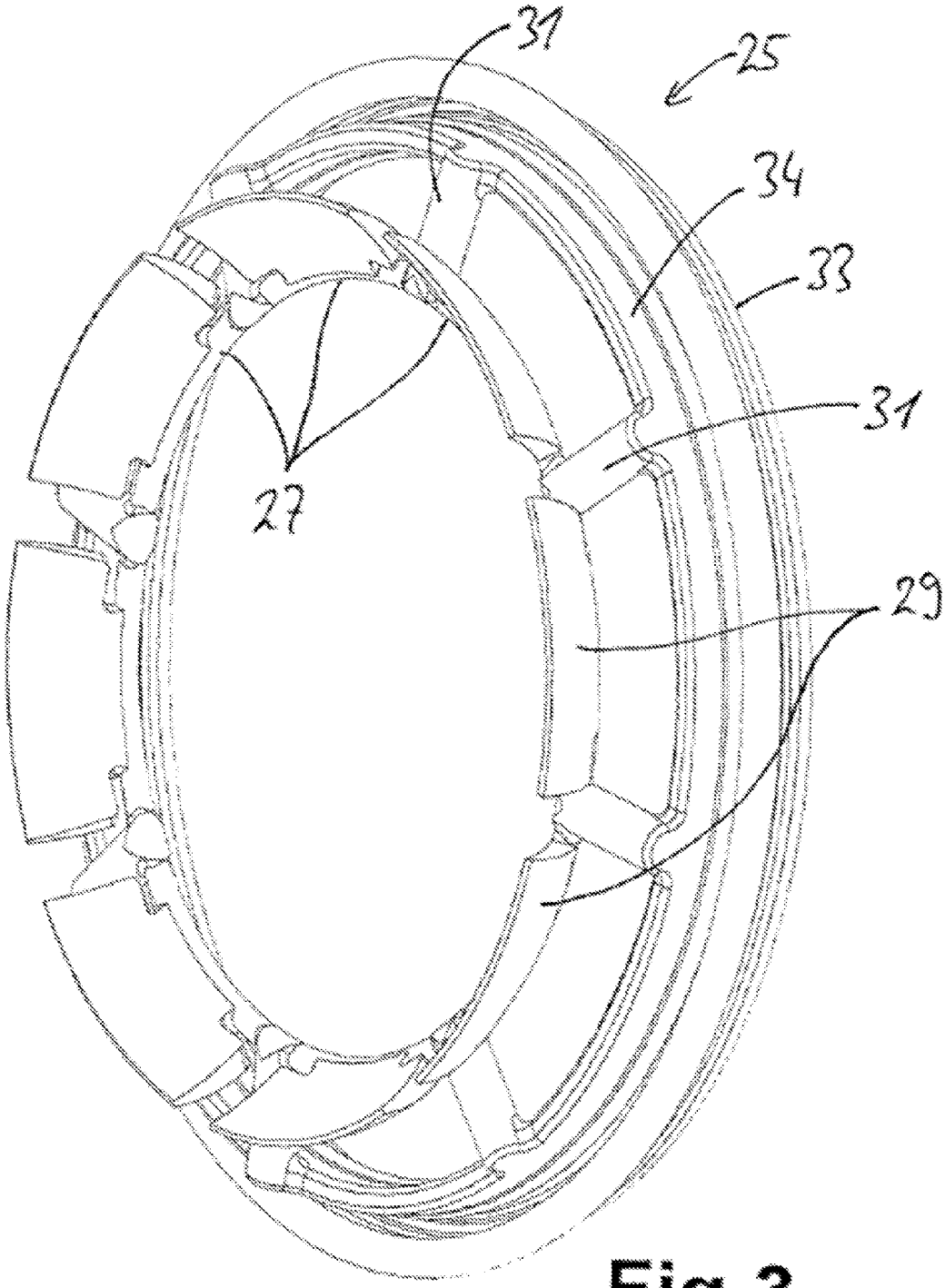
FIG. 3 shows the flow-guiding device from FIG. 2 with a strong flow with guide blades angled in a more pronounced manner FIGS. 4 to 6 respectively show side views of the flow-guiding device according to FIGS. 1 to 3 with a weak, medium and strong flow.

From the comparison with FIG. 3, which shows this same flow-guiding device 25 at maximum fluid flow in the pump 11, it can be seen that the guide blades 29 are pivoted upward or away from the V-seal 33 and consequently are angled in a more pronounced manner. In this way, they release a greater free cross sectional flow outward, which can also be seen from FIG. 1. This means that virtually the entire flow cross section is released, said cross section being formed radially outward from the V-seal 33 or from the radial inner ring section 34, and being defined radially inward by the carrier ring 27 which, in its turn, almost abuts against the top impeller disk 21 as well as against the pump cover 17. As a very large quantity of fluid is conveyed in the pump or through the pump chamber 13 and flows along on the chamber wall 14 and consequently on the heating element, in all cases its generated heat is removed and the fluid is also well heated. The fluid flow, therefore, does not need to be guided so strongly against the chamber wall 14.

The pivoting of the guide blades 29 about a pivot axis formed quasi by the carrier ring 27 is effected in that the carrier ring 27 is fabricated from easily twistable or overall resilient material, for example even from the same material as the sealing sections of the V-seal 33. Movement of the carrier ring or of its individual sections between the rigid holding webs 31 in the radial or axial direction of the pump hardly takes place. At the most, the carrier ring 27 could be moved in the axial direction away from the pump base 15, it abutting then evenly, as can be seen in FIG. 1, against the pump cover 17 and being supported by said pump cover. Movement radially outward is also hardly possible as due to the pressure, which the fluid flow flowing past on the outside exerts on the guide blades 29, they are more likely to be pressed radially inward. Whilst elastomers can be distorted relatively easily, their resistance force against crosswise bending or shearing is relatively great. Consequently, by means of sections of the carrier ring being resiliently formed in this manner, it is almost possible, as the end result, to achieve a type of pivot bearing arrangement for the guide blades 29 as if about a fixed pivot bearing. At the same time the effect of the spring characteristics of the resilient carrier ring 27 is that the guide blades 29 are angled in dependence on the flow pressure applied and consequently produce quasi self-regulation.

Figure 6:
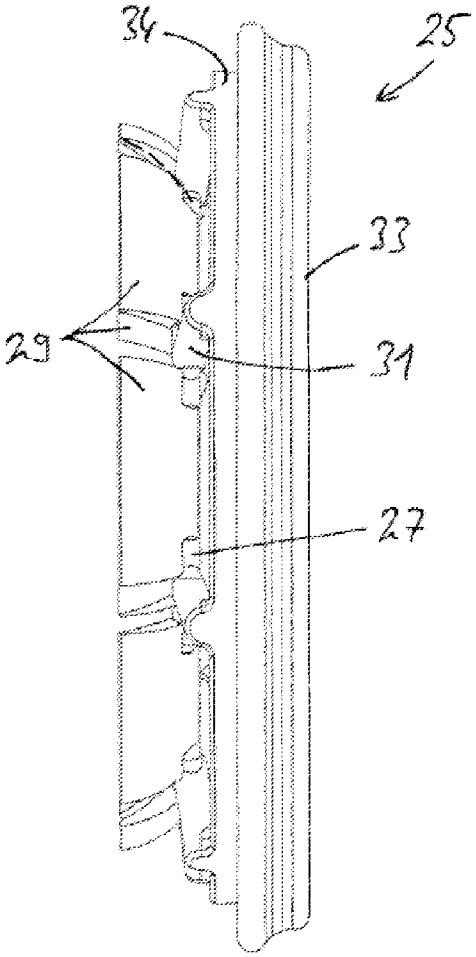
Figure 5:
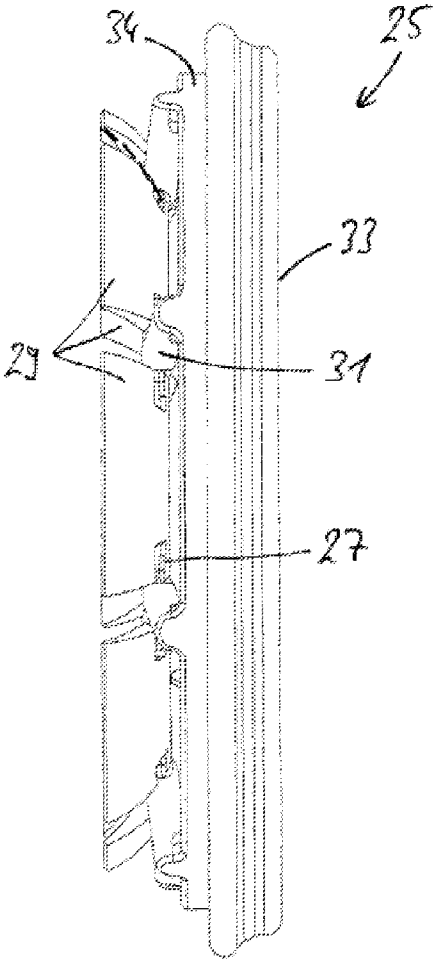

FIG. 4 shows once again how the guide blades 29 are angled when the fluid flow is slight or in the production state. FIG. 5 shows their position when the fluid flow is medium, which is already clearly stronger compared to FIG. 4, see also the angle specification given with regard to FIG. 1. In FIG. 6 they are angled even further when the fluid flow is strong or even when the fluid flow is the maximum that can be generated in the pump 11. With reference to FIG. 1, it can even possibly be provided that the guide blades 29, when the fluid flow is strong or at the maximum, abut almost as far as against the side of the pump cover 17 which points radially outward and consequently would be virtually completely out of the way.

The one-piece bearing arrangement of the guide blades 29 shown here, compared to one with moving parts, naturally has the great advantage that on the one hand it is producible in an integral manner and additional assembly steps are not applicable. In addition, bearing problems caused by tolerances during production or assembly and possible problems with increasing sluggishness of a bearing arrangement with moving parts caused by calcifying or the like are not applicable.

Figure 7:
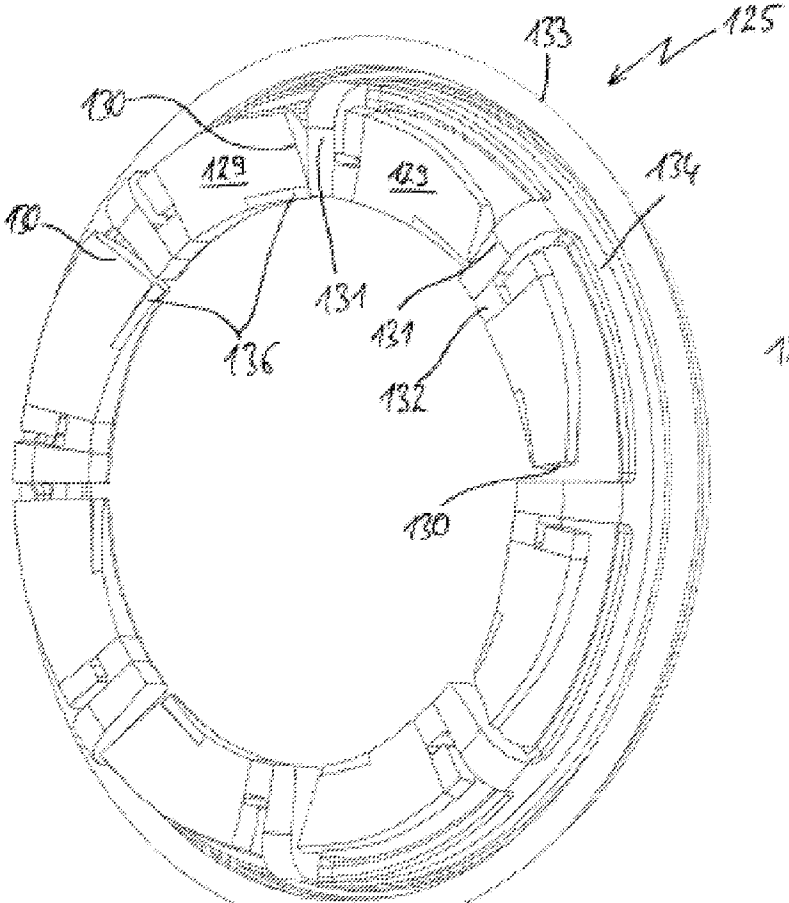
FIG. 7 shows an oblique representation of a flow-guiding device according to a second basic development of the invention with guide blades fastened on only one side.

FIG. 7 shows an alternative development of a flow-guiding device 125 corresponding to FIG. 2. In a similar manner to FIG. 2, radially inward protruding holding webs 131, which also consist of rigid material, are provided or integrally molded on an identically formed V-seal 133 with a radial inner ring section 134 as the holding ring. A guide blade 129 is mounted or integrally formed on their free ends in each case toward the right-hand side by means of a bearing arrangement section 132. The guide blades 129 have a substantially rectangular form similar to those from FIGS. 2 to 6. However, they are only quasi connected to the rigid holding web 131 at their one corner by means of the bearing arrangement section 132. They themselves consist of a rather elastomeric, soft plastics material. They are formed additionally in a resilient manner through their shaping, in particular the thickness, which reduces toward a free end 130 and can be seen from FIG. 7. Eight holding webs 131 with eight guide blades 129 thereon are provided in a similar manner as for the previously described flow-guiding device.

Figure 4:
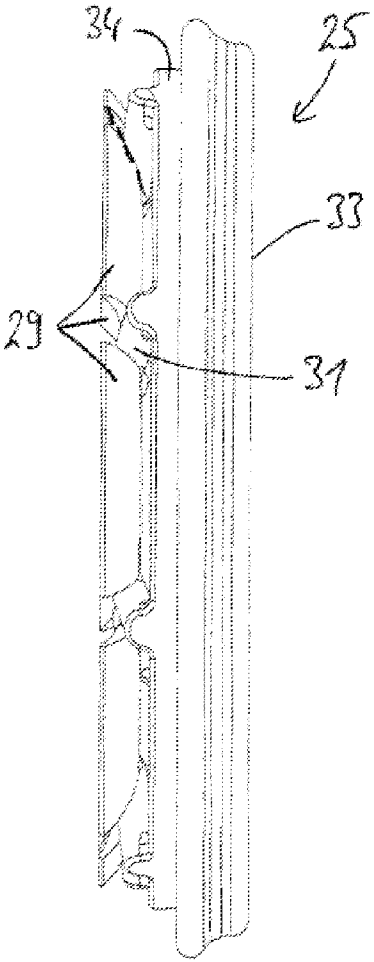
Figure 8:
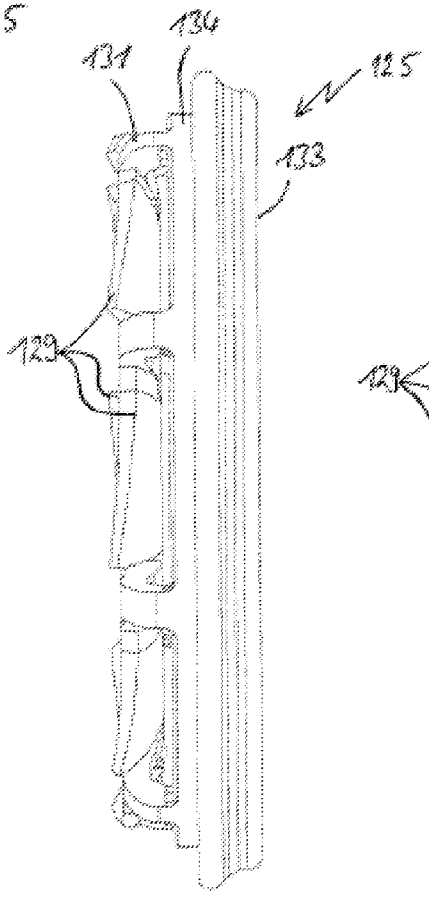

From the side view in FIG. 8, when comparing it to that from FIG. 4, it can be seen that the guide blades 129 have approximately the same blade angle, which, for a weak fluid flow, corresponds to the right-hand broken line in FIG. 1. Obviously, as can be seen in FIG. 8, the free end 130 of the guide blade 129, as a result of its own flexibility, must not be prevented from bending a little away from a pump base in the axial direction of the pump 11. In addition, it is somewhat distorted or twisted in the longitudinal direction, which becomes clearer below through the comparison with FIG. 9. The free end 130 of the guide blades 129 has a more pronounced blade angle than the other end of the guide blade 129 in the vicinity of the holding web 131 and the bearing arrangement section 132.

Figure 9:
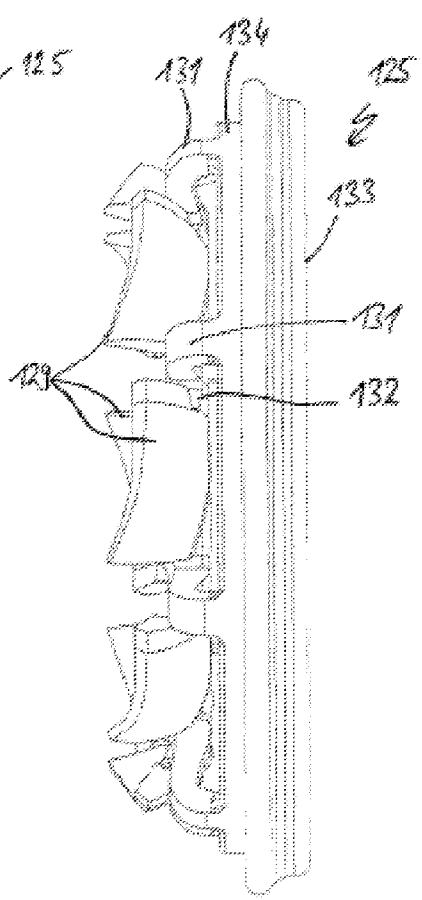
FIG. 8 shows the flow-guiding device from FIG. 7 from the side with a weak flow and FIG. 9 shows the flow-guiding device from FIG. 7 with a strong flow with the guide blades angled in a more pronounced manner.

It can be seen from FIG. 9 how the guide blades 129 are curved in an even more pronounced manner in the case of a strong fluid flow, that is to say corresponding to FIG. 6, and at the same time are curved or twisted in an even more pronounced manner with respect to their free end 130 and to the corner opposite the bearing arrangement section 132. This means that they take on a form approximately corresponding to the left-hand broken line according to FIG. 1, that is to say releasing a greater flow cross section in the case of a strong fluid flow and guiding the fluid onto the chamber wall in a somewhat weaker manner.

All in all, therefore, the goal of guiding the fluid conveyed in the pump against the chamber wall with the heating element in a stronger or less strong manner in dependence on the fluid flow is also achieved using the flow-guiding device 125 corresponding to FIGS. 7 to 9. The advantage of the design of the guide blades 129 with a one-sided bearing arrangement or a bearing arrangement on a corner is that in the case of fluid circulating out of the drawing plane in a clockwise manner with reference to FIG. 7, such guide blades 129 which are curved inward in a more pronounced manner towards the free ends 130 promote the flow to a greater degree. This means that they are also curved inward somewhat in the circumferential direction of the fluid and reduce the flow resistance in this manner.

In a similar manner as already described for the other flow-guiding device 25, a multi-component injection molding technique can also be used for the flow-guiding device 125. This does not only apply to the V-seal 133 and the radial inner ring section 134 including the holding webs 131 fabricated from more sturdy material. For example, the bearing arrangement sections 132 between the holding web 131 and the guide blades 129 can consist of a softer or also of a harder material. The same applies to the guide blades 129 per se.

In addition, an indentation 136 is provided in each case on the free ends 130 of the guide blades 129 as a type of additional cross-sectional tapering. Said indentations 136 can also serve for the purpose of effecting abutment against the pump cover 17 when the guide blades 129 are pivoted to their maximum distance so that from this point the guide blades 129 certainly still twist where possible in a similar manner to those from FIGS. 2 to 6. At least, however, they no longer bend in their longitudinal development.

In addition, it can be provided generally in an advantageous manner for the invention that the holding webs 31 and 131 are formed with a flow-promoting cross section, that is to say they are not forcibly rectangular or sharp-edged as is shown here for the sake of simplicity, but are rounded.

The invention claimed is:

1. Flow-guiding device for a centrifugal pump, wherein an impeller rotates in a pump chamber for conveying fluid or for discharging the fluid in a radial direction out of the impeller, circulating in the pump chamber toward a pump discharge port, wherein the flow-guiding device is to be arranged radially outside the impeller and is formed so as to extend in a ring-shaped manner with a circumferential carrier ring, on which either one continuous flow lip or several individual guide blades are arranged at a blade angle with respect to the longitudinal center axis of the pump, said flow lip or guide blades being formed so as to be resilient or movable in such a manner that when there is a small fluid flow of conveyed fluid the blade forms a substantially 90° angle or more with the longitudinal central axis of the pump, and when there is a large or a maximum fluid flow the blade angle becomes less than 90° and the flow lip or the guide blades curve or move in a resilient manner toward the longitudinal center axis of the pump at least partially.

2. Flow-guiding device according to claim 1, wherein when there is a small fluid flow of conveyed fluid, the blade angle is between 75° and 90°.

3. Flow-guiding device according to claim 1, wherein when there is a large or maximum fluid flow the blade angle becomes smaller and the flow lip or the guide blades protrude at a blade angle of between 20° and 60° with respect to the longitudinal center axis of the pump.

4. Flow-guiding device according to claim 1, wherein the flow lip or the guide blades protrude from the carrier ring toward the pump discharge port in an angled manner.

5. Flow-guiding device according to claim 1, wherein the carrier ring is arranged somewhat above the impeller on an inner wall of the pump chamber, wherein the flow lip or guide blades protrude from the carrier ring outwardly in the radial direction.

6. Flow-guiding device according to claim 1, wherein the carrier ring is connected to a circumferential holding ring by means of radial holding webs, wherein the holding webs extend radially outward and the holding ring has a larger diameter than the carrier ring.

7. Flow-guiding device according to claim 6, wherein the cross section of the holding webs has a flow-promoting profile with a widely rounded front side being turned against the fluid flow and tapering toward the rear side.

8. Flow-guiding device according to claim 1, wherein the flow lip is circumferentially closed and is formed so as to extend in a uniform manner, wherein it protrudes from the carrier ring in an angled manner or radially outward in the direction toward an outer pump chamber wall.

9. Flow-guiding device according to claim 8, wherein the flow lip is formed so as to be resilient or movable about the carrier ring without pivotably movable parts.

10. Flow-guiding device according to claim 1, wherein the guide blades are narrow and oblong extending in the circumferential direction and have an approximately rectangular surface.

11. Flow-guiding device according to claim 10, wherein a guide blade extends as far as just in front of an adjacent guide blade or a holding web of the adjacent guide blade such that an almost gap-free closed circumferential ring of guide blades is provided.

12. Flow-guiding device according to claim 1, wherein each guide blade is connected to the carrier ring by way of its radially inside longitudinal edge.

13. Flow-guiding device according to claim 12, wherein each guide blade is produced integrally with the carrier ring.

14. Flow-guiding device according to claim 12, wherein a region of the carrier ring between the guide blade and a holding web supporting the carrier ring is formed in a resilient manner or is formed in a rubber-elastic manner.

15. Flow-guiding device according to claim 14, wherein the thickness of the carrier ring corresponds approximately to the thickness of the guide blade in the connecting region.

16. Flow-guiding device according to claim 12, wherein the thickness of the guide blade is reduced in the direction from radially inside to radially outside.

17. Flow-guiding device according to claim 12, wherein a guide blade is connected to the holding web by way of only part of its width for torsion along its longitudinal axis in the circumferential direction.

18. Flow-guiding device according to claim 17, wherein the radially inside part of the guide blade is connected to the holding web or is formed integrally therewith.

19. Flow-guiding device according to claim 17, wherein each guide blade is fastened on precisely one holding web by way of a corner region.

20. Flow-guiding device according to claim 19, wherein the thickness and strength of the guide blades reduce from the fastening of the guide blades on one corner region toward an opposite corner region.

21. Flow-guiding device according to claim 17, wherein the thickness tapering of the guide blade in its longitudinal development amounts to the factor of 1.5 to 3, wherein the thickness of the guide blade also reduces in the direction from radially inside to radially outside such that the overall thickness of the guide blade reduces from one corner region of the fastening on the holding web as far as the corner region situated in an angular manner opposite.

22. Flow-guiding device according to claim 17, wherein the guide blade is formed for tipping and pivoting at the same time depending on the fluid flow.

23. Flow-guiding device according to claim 22, wherein as the volume flow increases the guide blade tips and pivots as far as up to a stop on the pump housing and then just tips.

24. A centrifugal pump having a pump housing and a flow-guiding device arranged therein, wherein an impeller rotates in a pump chamber for conveying fluid or for discharging the fluid in the radial direction out of the impeller, circulating in the pump chamber toward a pump discharge port, wherein the flow-guiding device is to be arranged radially outside the impeller and is formed so as to extend in a ring-shaped manner with a circumferential carrier ring, on which either one continuous flow lip or several individual guide blades are arranged at a blade angle with respect to the longitudinal center axis of the pump, said flow lip or guide blades being formed so as to be resilient or movable in such a manner that when there is a small fluid flow of conveyed fluid the blade forms a substantially 90° angle or more with the longitudinal central axis of the pump, and when there is a large or a maximum fluid flow the blade angle becomes less than 90° degrees and the flow lip or the guide blades curve or move in a resilient manner toward the longitudinal center axis of the pump at least partially.

25. Pump according to claim 24, wherein the carrier ring is arranged downstream of the impeller in the pump chamber of the pump on the outer side close to the pump chamber wall.

26. Pump according to claim 24, wherein the carrier ring is arranged somewhat above the impeller on an inner wall of the pump chamber and the flow lip or guide blades protrude therefrom in the radial direction outward.

27. Pump according to claim 24, wherein the carrier ring is fastened on a holding ring by means of holding webs, wherein the holding ring is fastened on the pump housing radially outside the impeller.

* * * * *